US005261139A

United States Patent [19]

Lewis

[11] Patent Number: 5,261,139

[45] Date of Patent: Nov. 16, 1993

[54] RAISED BASEBOARD BRUSH FOR POWERED FLOOR SWEEPER

[76] Inventor: Steven D. Lewis, 114 N. Seventh, Knoxville, Iowa 50138

[21] Appl. No.: 980,361

[22] Filed: Nov. 23, 1992

[51] Int. Cl.[5] ..... A47L 11/24

[52] U.S. Cl. ..... 15/49.1; 15/42; 15/87

[58] Field of Search ..... 15/49.1, 50.1, 98, 42, 15/87, 53.4, 385, 246

[56] References Cited

U.S. PATENT DOCUMENTS

| | | | |
|---|---|---|---|
| 1,988,024 | 1/1935 | Tilke | 15/50.1 |
| 2,124,705 | 7/1938 | Locklin | 15/49.1 |
| 3,473,180 | 10/1969 | Lenhart | 15/50.1 |
| 3,533,120 | 10/1970 | Demercado | 15/50.1 |
| 3,825,968 | 7/1974 | Larsen . | |
| 4,024,597 | 5/1977 | Fouracre | 15/49.1 |
| 4,099,284 | 7/1978 | Shinozaki et al. . | |
| 4,177,533 | 12/1979 | Liebscher et al. . | |
| 4,219,901 | 9/1980 | Burgoon et al. . | |
| 4,219,902 | 9/1980 | DeMaggd . | |
| 4,464,804 | 8/1984 | Hopkins . | |
| 4,691,402 | 9/1987 | Veselka . | |

*Primary Examiner*—Edward L. Roberts
*Attorney, Agent, or Firm*—Henderson & Sturm

[57] ABSTRACT

A raised powered baseboard brush apparatus (10) for use on top of a conventional corner sweeper attachment (100) for a powered floor sweeper (200) for engaging a rotating elevated baseboard brush member (26) into contact with the top portion of a baseboard (50) disposed parallel to the line of travel of the powered floor sweeper (200).

5 Claims, 4 Drawing Sheets

RAISED BASEBOARD BRUSH FOR POWERED FLOOR SWEEPER

TECHNICAL FIELD

The present invention relates to the field of dual brush sweeping devices in general, and in particular to the provision of a raised baseboard brush which is mounted above and operatively connected to a powered floor sweeper for the purpose of simultaneously cleaning both the floor and an adjacent raised baseboard.

BACKGROUND ART

As can be seen by reference to the following U.S. Pat. Nos. 4,099,284; 4,219,902; 4,464,804; and 4,177,533; the prior art is replete with myriad and diverse dual brush sweeping devices wherein the individual brushes are oriented at an angle relative to one another.

While all of the aforementioned prior art constructions are more than adequate for the basic purpose and function for which they have been specifically designed, these patented dual brush sweepers are uniformly deficient in a number of significant areas.

To begin with all of the above mentioned sweepers dispose their brushes in the same general horizontal plane; and none of the dual brush arrangements employ relative rotation about two distinct vertically displaced axis.

In addition, none of the aforementioned patented devices employs a common power source to drive the dual power brushes from a single driven axis.

As a consequence of the foregoing situation, there has existed a longstanding need among users of powered floor sweepers for an arrangement which will incorporate an elevated powered brush onto the powered sweeper, so that both a floor surface and a raised baseboard surface may be cleaned simultaneously; and the provision of such a construction is a stated objective of the present invention.

DISCLOSURE OF THE INVENTION

Briefly stated, this invention comprises an elevated driven baseboard brush unit which is mounted on top of a conventional sweeper attachment disposed on one corner of a powered floor sweeper.

In addition, the baseboard brush unit is operatively connected to the driven axle of the conventional corner sweeper attachment via a power take-off linkage which is spring biased in such a manner as to allow the baseboard brush unit to be pivoted away from its spring biased orientation when the brush unit encounters an elevated obstacle.

As will be explained in greater detail further on in the specification, the vertical positioning of the powered baseboard brush unit may be varied thru the use of an optional adapter unit; such that the baseboard brush unit may be positioned at the proper height to effect the cleaning of both the top of the baseboard and the bottom of a bumper strip such as would be encountered at a medical facility.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
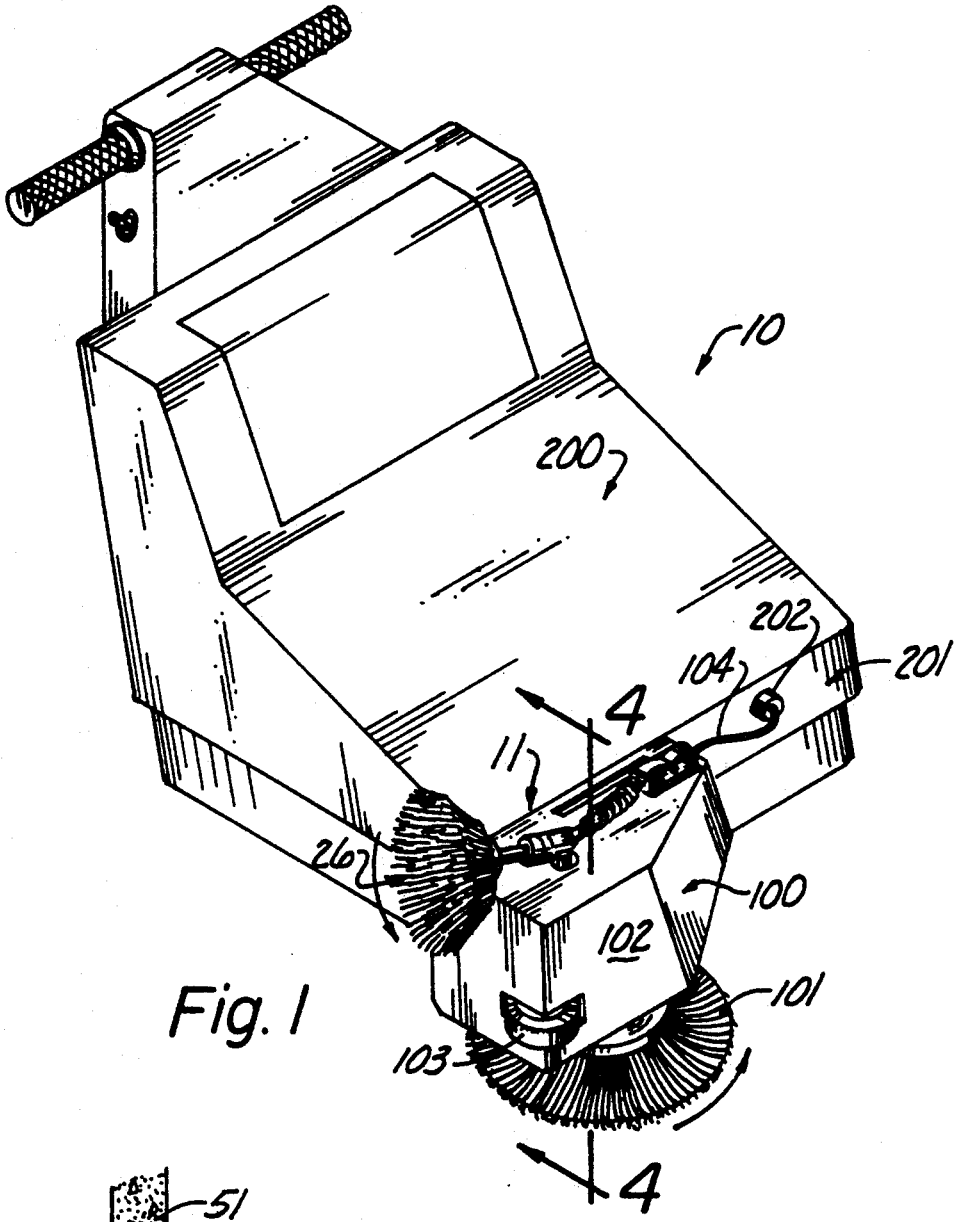
FIG. 1 is a perspective view of the raised baseboard brush, which forms the basis of the present invention, disposed on a powered floor sweeper.

As can be seen by reference to the drawings, and in particular to FIG. 1, the raised powered baseboard brush apparatus that forms the basis of the present invention is designated generally by the reference numeral (10). The baseboard brush apparatus (10) comprises in general a conventional corner sweeper attachment (100) for a powered floor sweeper (200); wherein, the conventional corner sweeper attachment (100) is provided with a powered baseboard brush unit (11).

Figure 2:
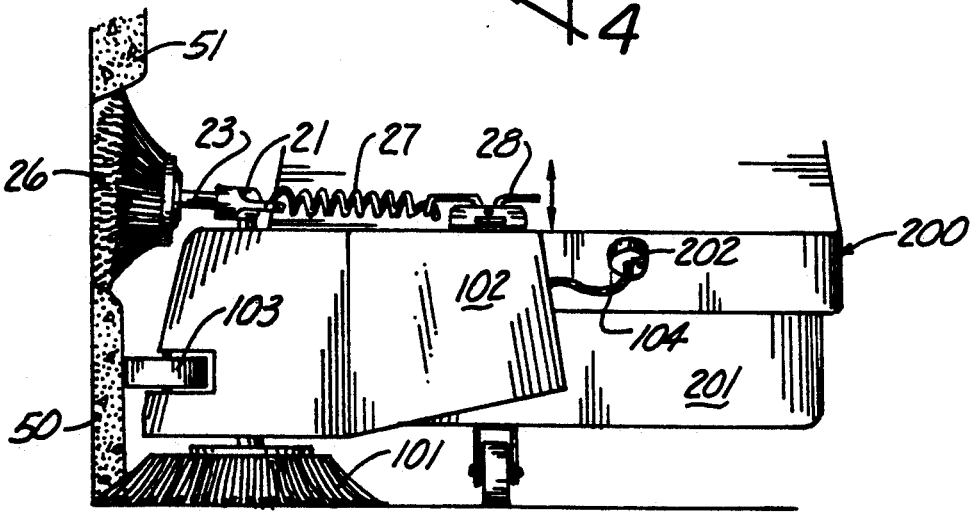
FIG. 2 is a front elevation view of the invention installed on a powered floor sweeper.
Figure 3:
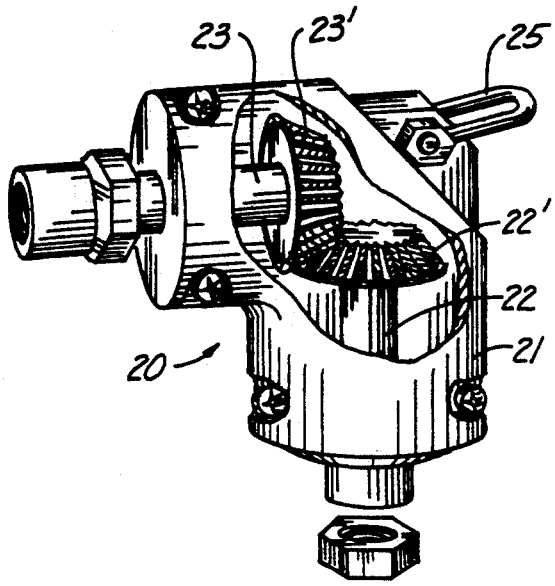
FIG. 3 is a top elevation view of the invention installed on a powered floor sweeper.
Figure 3:
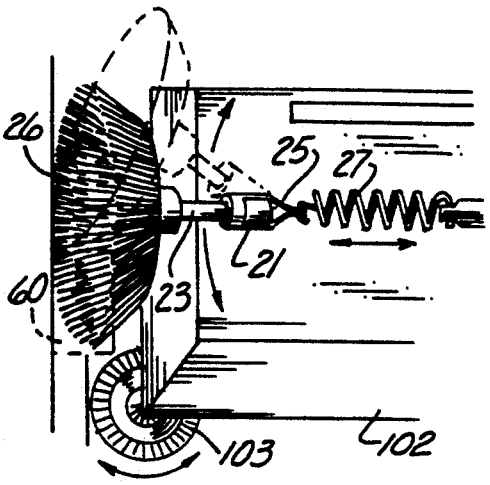

As shown in FIGS. 1 thru 3, the corner sweeper attachment (100) is attached to one side of the front face (201) of a powered floor sweeper (200) wherein, the conventional corner sweeper attachment includes in general a driven corner brush element (101) projecting downwardly from a corner sweeper housing element (102) which is equipped with a guide roller (103) and has a power outlet cord (104) operatively connected to a suitable receptacle (202) on the powered floor sweeper (200) for providing electrical current to the sweeper attachment (100).

Figure 4:
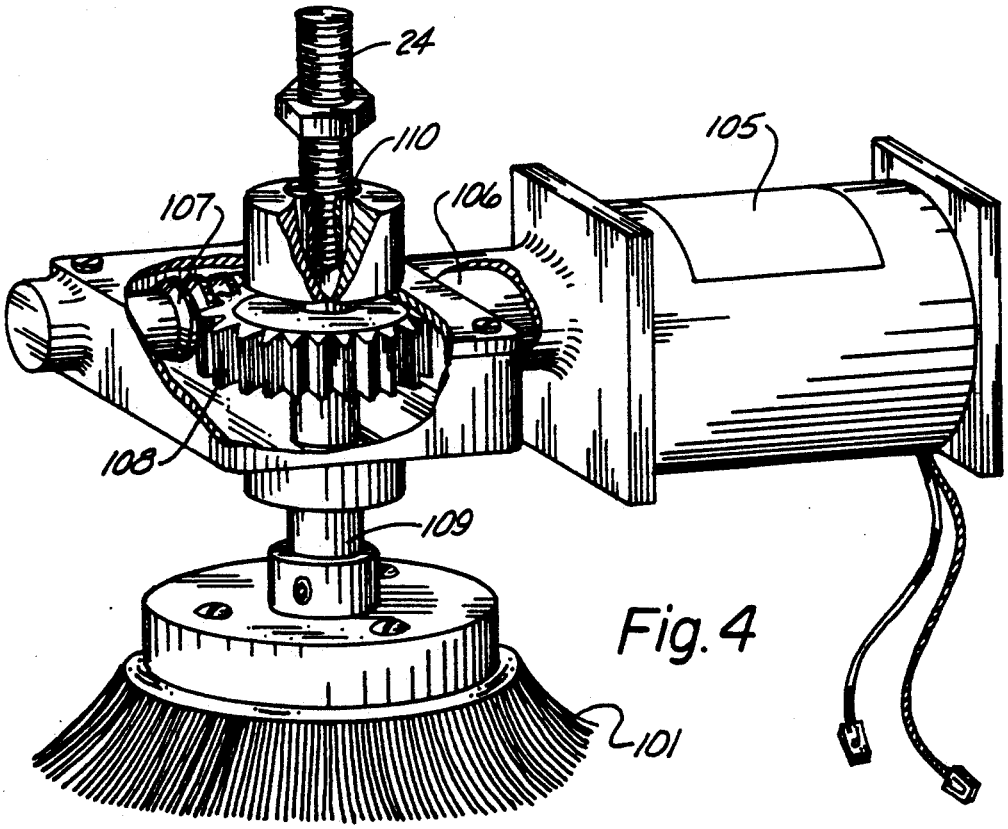
FIG. 4 is an exploded perspective view of the operative engagement between the baseboard brush unit and the conventional corner sweeper attachment.

Turning now to FIG. 4, a slightly different embodiment is shown with corner sweeper housing element (102) contains an electrical motor (105) having a main output shaft (106) provided with helical gear teeth (107) which operatively engage a toothed drive gear (108) which is rigidly secured to the main drive shaft (109); wherein, the corner brush element (101) is secured to the lower end of the main drive shaft (109) in a well recognized manner.

Still referring to FIG. 4, it can be seen that the upper end of the main drive shaft (109) is further provided with a threaded bore (110) whose purpose and function will be described in conjunction with the description of the baseboard brush unit (11).

The baseboard brush unit (11) comprises an angle gear member (20) having a generally L-shaped housing (21) which contains two perpendicularly aligned, hollow internally threaded drive shaft (22) (23) having conical gear elements (22') (23') formed on one end which cooperate with one another in a well recognized fashion.

In addition, the baseboard brush unit (11) further comprises an elongated threaded extension member (24) whose lower end is threadedly engaged in the threaded bore (110) of the main drive shaft (109) and whose upper end is threadedly engaged in the vertically disposed drive shaft (22); such that the rotary motion of the main drive shaft (109) is transmitted from the vertically disposed drive shaft (22) to the horizontally disposed drive shaft (23).

As can also be seen by reference to FIG. 4, the rear of the baseboard brush housing (21) is provided with a hook element (25), and is shown in FIGS. 1 thru 3. The horizontally disposed drive shaft (23) is adapted to threadedly engage the threaded stem (not shown) of a baseboard brush member (26).

Figure 5:
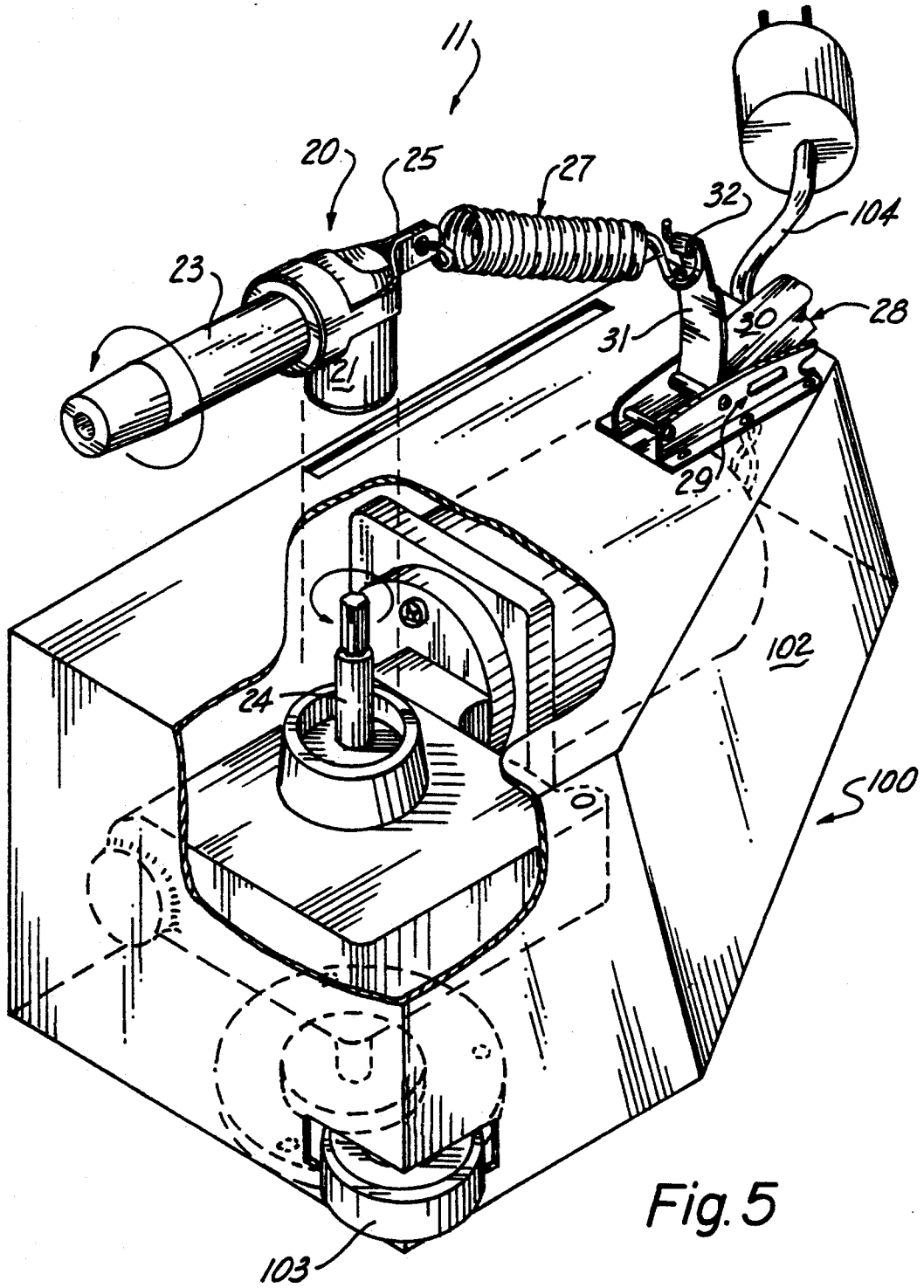
FIG. 5 is another exploded perspective view of the arrangement depicted in FIG. 4.
Figure 7:
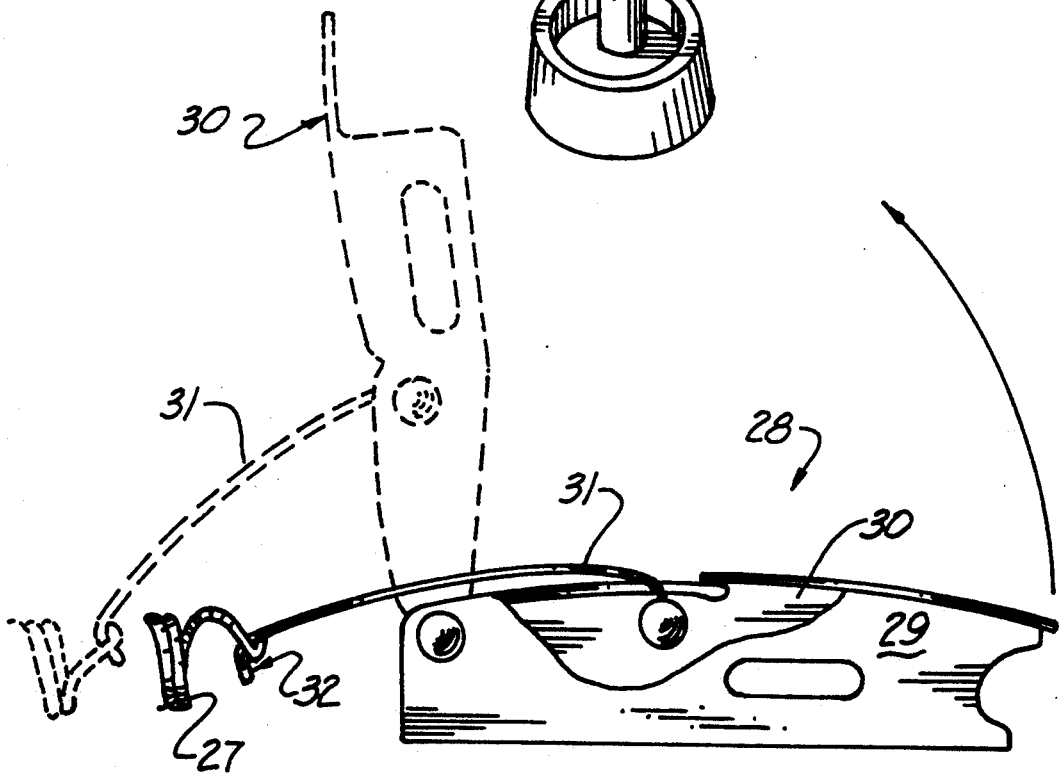

As can best be seen by reference to FIGS. 5 and 7, the baseboard brush unit (11) further comprises a helical spring member (27) which is attached on one end to the hook element (25) on angle gear housing (21) and attached on the other end to an over-center catch release member (28) which is affixed to the top of the corner sweeper housing element (102).

As shown in FIG. 7, the over-center catch release member (28) comprises a base element (29) that is secured to the top of the corner sweeper housing element (102); wherein, a latch release arm (30) is pivotally secured to one end of the base element (29).

In addition, a latch arm (31) is pivotally secured proximate the midpoint of the latch release arm (30); and is further provided with a hook portion (32) which is adapted to engage one end of the helical spring member (27).

As can be seen by reference to FIGS. 2 and 3, in the operative mode of disposition the over-center catch release member (28) maintains the helical spring (27) in a state of tension to deploy the baseboard brush member (26) generally perpendicular to the line of travel of the powered floor sweeper (200) so that the raised baseboard brush member (26) comes into contact with the top of a baseboard (50) and the bottom of a bumper strip (51) (if one is present).

In addition, the helical spring member (27) also permits the baseboard brush member (26) to flex away from contact with an obstacle such as is designated by the reference numeral (60) in FIG. 3. Also when the baseboard brush member (26) is not in use, the catch release member (28) may be deployed as shown in FIG. 5, to release the tension on the spring member (27) so that the baseboard brush unit (11) may be turned in the direction of travel of the powered sweeper (200) or removed and lifted off of its engaging drive shaft.

Figure 6:
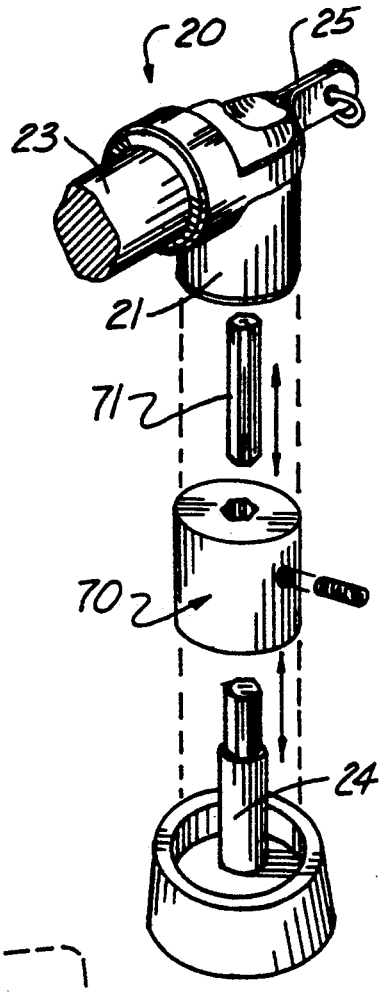
FIG. 6 is an exploded perspective view of the operative engagement of the adapter unit with the baseboard brush unit; and, FIG. 7 is an enlarged detail view of the spring catch release mechanism.

Turning now to FIG. 6, it can be seen that in those instances, wherein, additional elevation of the baseboard brush unit (11) is desired; an extension collar (70) and intermediate shaft (71) can be employed on the elongated extension member 24 to raise the baseboard brush unit (11) to a selected height.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A raised baseboard brush apparatus in combination with a conventional corner sweeper attachment includes: a housing element having a top and containing, a motor driven main drive shaft; wherein the apparatus comprises:

an angle gear member including a first vertically oriented drive shaft attached to the upper end of the main drive shaft of the corner sweeper attachment, said angle gear member rotatably disposed about the upper end of said first drive shaft, and a second horizontally oriented drive shaft operatively engaged with the vertically oriented drive shaft; wherein, the horizontally oriented drive shaft is disposed above and beyond the top of housing element of the carpet sweeper attachment;

a baseboard brush member operatively attached to the outboard end of the horizontally oriented drive shaft; and, means for biasing the horizontally oriented drive shaft in a direction perpendicular to the direction of travel of said powered floor sweeper.

2. The apparatus as in claim 1; wherein, said angle gear member further includes a housing which surrounds at least a portion of the horizontally and vertically oriented drive shafts.

3. The apparatus as in claim 2; wherein, the means for biasing the horizontally oriented drive shaft includes:

a helical spring member connected on one end to the housing of the angle gear member.

4. The apparatus as in claim 3, wherein, the means for biasing the horizontally oriented drive shaft includes:

a catch release member secured to the top of the corner sweeper attachment and operatively connected to the other end of the said helical spring member.

5. The apparatus as in claim 1, further including:

means for adjusting the vertical height of the horizontally oriented drive shaft relative to the top of the corner sweeper attachment.

* * * * *